United States Patent [19]

Perkins

[11] 4,262,832

[45] Apr. 21, 1981

[54] VEST-TYPE SHOULDER HOLSTER FOR CARRYING FIREARMS

[75] Inventor: Neale A. Perkins, Bradbury, Calif.

[73] Assignee: Safariland Ltd. Inc., Monrovia, Calif.

[21] Appl. No.: 98,983

[22] Filed: Nov. 30, 1979

[51] Int. Cl.[3] ..... A41D 1/04; F41C 33/00

[52] U.S. Cl. ..... 224/206; 224/191; 224/202; 224/229; 224/230; 2/102; 224/911

[58] Field of Search ..... 224/191, 202, 205, 206, 224/229, 230, 911

[56] References Cited

U.S. PATENT DOCUMENTS

| | | | |
|---|---|---|---|
| 703,684 | 7/1902 | Wade | 2/102 |
| 1,797,359 | 3/1931 | Meyers | 224/206 X |
| 2,579,782 | 12/1951 | Booth | 224/911 X |
| 2,604,627 | 7/1952 | Abbott | 224/191 X |
| 3,530,508 | 9/1970 | Pavlou et al. | 2/102 |
| 4,022,361 | 5/1977 | Devlin | 224/911 X |
| 4,068,784 | 1/1978 | Angell | 224/206 X |

*Primary Examiner*—Steven M. Pollard

*Attorney, Agent, or Firm*—Christie, Parker & Hale

[57] ABSTRACT

A vest-type shoulder holster for carrying a firearm comprises a vest for being worn on the upper body, and a pocket on an inside portion of the vest overlying a side of the chest region generally under the arm. A holster is carried in the pocket in a concealed manner when a coat is worn over the vest. The pocket extends upwardly and frontward on an angle and faces toward the opposite side of the vest. Cooperating fasteners are located inside the pocket and on the holster for releasably securing the holster in the pocket. A second inside pocket can be provided in a similar location on the opposite side of the vest for carrying accessories.

16 Claims, 5 Drawing Figures

VEST-TYPE SHOULDER HOLSTER FOR CARRYING FIREARMS

BACKGROUND OF THE INVENTION

This invention relates to holster, and more particularly to a device for carrying a firearm in a holster supported on the upper body in a concealed manner.

Law enforcement officers are often required to carry a firearm concealed under a jacket or coat. In the past, it has been common for law enforcement officers to carry a shoulder holster supported from a harness having a strap that encircles each shoulder and extends across the neck. The strap over the shoulders that holds the holster can be made from leather and the other strap portion of the harness can be an elastic strap. The holster is attached to or suspended from the leather shoulder straps. The strap that extends across the back is fastened to a buckle or the like to adjust the length of the strap so the harness makes a tight fit around the upper body for holding the holster in a reasonably fixed position.

These prior art shoulder holsters suffer from a number of disadvantages. They are uncomfortable because of pressure points caused by the straps of the harness being adjusted tightly around the upper body to hold the holster in place. The shoulder straps usually fit tightly under the arm, which can be particularly uncomfortable. These harness-type shoulder holsters do not easily conceal the weapon because the harness creates noticeable bulges or lumps under a jacket or coat. The jacket or coat also is not freely movable on the upper body, but can snag on various parts of the shoulder holster or harness. Further, when the officer reaches across his body to draw the firearm from the holster, the holster tends to back up, owing to the tight fit of the harness, which transfers the officer's movements to the holster, tending to move the holster.

The present invention provides a vest-type shoulder holster which overcomes these disadvantages and provides additional advantages over prior art shoulder holsters.

SUMMARY OF THE INVENTION

Briefly, the invention provides a vest for being worn on the upper body and adapted to carry a firearm while using the uniform weight distribution of the vest as a means for supporting the firearm on the upper body. The vest has an inside face and an outside face, and a lower front portion of the vest extends adjacent the underarm on the front side of the upper body when the vest is worn. A pocket is secured to the inside face of the lower front portion of the vest. The pocket is adapted to carry a holster shaped to fit inside the pocket. The holster can have a fastener on it for being releasably secured to a corresponding fastener in the vicinity of the pocket for releasably securing the holster in a fixed position in the pocket.

The vest can have a pair of narrow elongated upper front pieces that extend over the shoulders from a back section that extends across the back. The upper front pieces extend down along the front of the shoulders to merge into somewhat wider lower front pieces of generally uniform width that extend under the arms and attach to opposite sides of the back section. When the vest is worn a firearm can be carried in a holster secured in the inside pocket and located at the side of the chest area generally under the arm. The vest distributes the weight of the holster and firearm over a broad area, which provides much greater comfort than a harness, having tightly adjusted straps extending over the shoulders and across the back. The vest eliminates the need for adjustable straps and avoids bulges of lumps in a jacket or coat worn to conceal a weapon. The jacket or coat is freely movable relative to the vest, which avoids snagging and aids in concealment of the weapon. The improved weight distribution of the vest also prevents the firearm from moving or backing up when the officer reaches across his chest to withdraw the firearm. In addition, the vest can provide means for carrying accessories on the side of the vest opposite the firearm. Further, the pocket that carries the holster can be arranged to provide means for adjusting the position of the holster, and therefore the firearm, over a wide range of positions.

These and other aspects of the invention will be more fully understood by referring to the following detailed description and the accompanying drawings.

DRAWINGS

DETAILED DESCRIPTION

Figure 1:
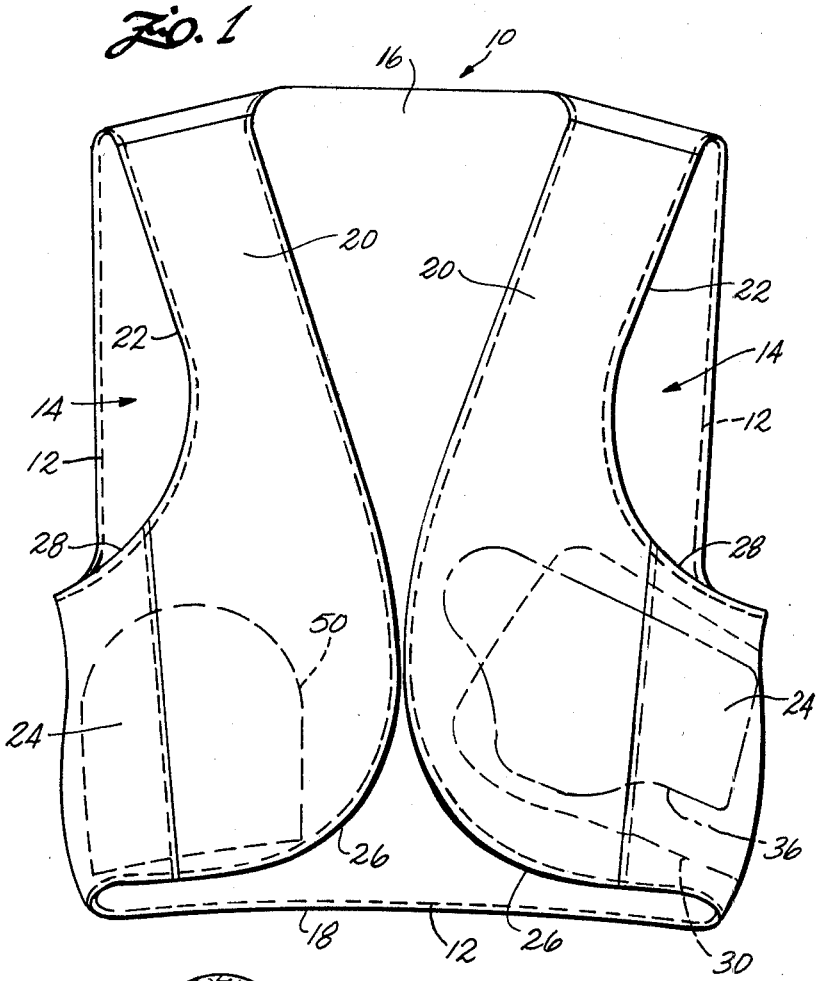
FIG. 1 is a front elevation view showing a vest-type shoulder holster in flat form.
Figure 4:
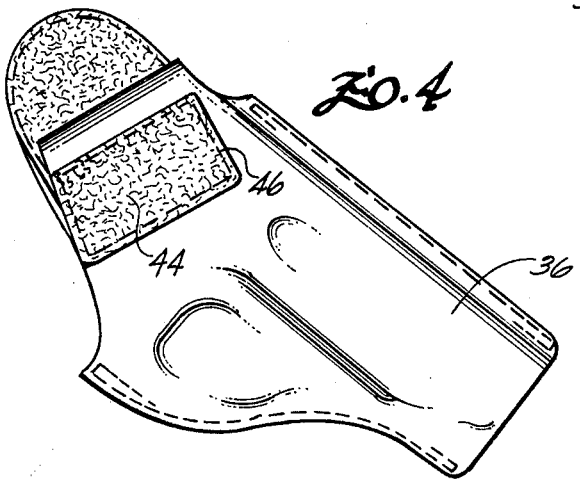
FIG. 4 is a side elevation view taken from the opposite side of the holster shown in FIG. 3.
Figure 2:
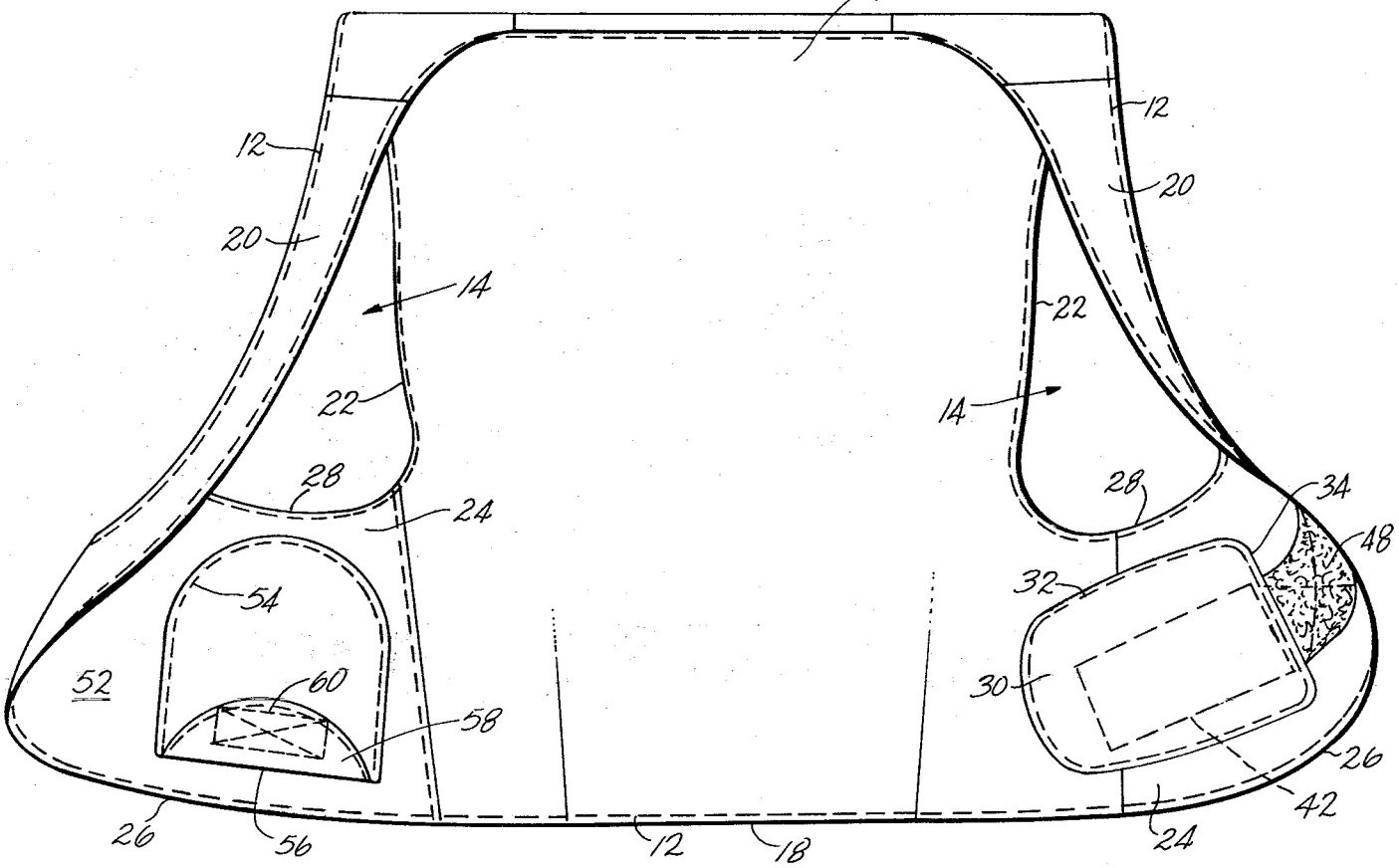
FIG. 2 is a front elevation view showing the vest-type shoulder holster in flat form with its front portions folded back to show the inside of the vest.
Figure 3:
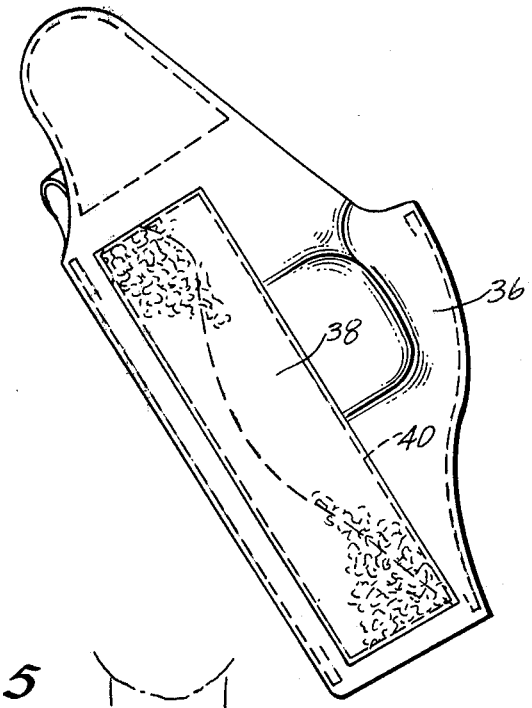
FIG. 3 is a side elevation view showing a holster adapted to be carried in the vest.

A device for carrying a firearm in a concealed manner comprises a vest 10 for being worn on the upper body. The vest is shown in flat form in FIG. 1. The vest is made from a flexible, machine washable fabric, and preferably comprises an outer sheet of nylon and an inner lining of polyester fabric. The vest can be reinforces by an internal layer of ballistic nylon. The different materials that form the vest are statched together by peripheral stitching 12.

Armholes 14 are formed on opposite sides of the vest for accommodating the arms of the user when the vest is worn on the upper body. A generally rectangular back section 16 overlies the back of the user. The back section has a bottom edge 18 for extending approximately across the mid-point between the waist and the underarms when the vest is worn.

A pair of laterally spaced apart, narrow, elongated upper front pieces 20 are secured to upper outside portions of the back section. The upper front pieces are of generally uniform width and converge downwardly along front side edges 22 of the armholes. The bottoms of the upper front pieces merge gradually into lower front pieces 24 that extend under the armholes to opposite lower sides of the back section 16. Each lower front section has a curved outer edge 26 that extends generally parallel to the curved bottom edge 28 of the armhole 14 above it. The upper and lower front pieces gradually taper wider as they merge. The two lower front pieces are of substantially uniform width under each armhole. When the vest is in flat form, as in FIG. 1, the outer edged 26 of the lower front pieces do not appreciably overlap, but are either spaced apart from one another by a small gap, or their outer edges barely overlap. When the vest is in flat form, the minimum spacing between outer edges 26 is generally at about the mid-point between the bottom of the lower front pieces and the bottom edges of the armholes.

In one embodiment, the width of the lower front pieces is about 1.5 to 2.5 times the width of the upper front pieces. The maximum width of the lower front pieces is about 40 to 70% of the vertical diameter of the armholes. The upper front pieces can be about 2½ to 3 inches wide, gradually tapering about 5½ to 6½ inches in width at the maximum width of the lower front pieces, i.e., below the armholes. The maximum vertical distance between the top and bottom of the back section is about 16 to 17 inches and the vertical diameter of the armholes is about 9 to 10 inches.

A pocket 30 is secured to the inside portion of one of the lower front pieces 24. The pocket is secured by peripheral stitching 32 that has an opening 34 that faces toward the opposite side of the vest when the vest is in flat form, as illustrated in FIG. 1. The pocket preferably extends at an angle with respect to a horizontal line drawn through the bottom edges of the armholes. The angle of the pocket is about 30° to 45° relative to such a horizontal line.

The pocket is adapted to carry a holster 36. The pocket preferably is oversized with respect to the holster so the holster can be held in the pocket in one of a number of selected orientations. Cooperating fastening means are provided on the exterior of the holster and in the vicinity of the pocket for releasably holding the holster in a fixed desired position in the pocket. The fastening means are preferably provided by an elongated strip 38 of thistle cloth pile material secured to the holster by stitching 40 and a similarly shaped elongated strip of thistel cloth hook material 42 secured to the inside of the pocket 30. The thistle cloth material can be the type sold under the trademark "Velcro". The holster can be positioned inside the pocket in any of a number of desired orientations and the thistle cloth fasteners 38 and 42 pressed into contact with each other for securely holding the holster in the selected orientation. The opposite side of the holster can include a shorter strip 44 of the thistle cloth pile material secured adjacent the upper portion of the holster by stitching 46. This fastener can releasably attach to a cooperating short strip 48 of thistle cloth hook material secured to the inside face of the vest adjacent the opening 34 of the pocket. The thistle cloth fasteners 44 and 48 can be pressed into contact to provide additional means for securely holding the holster in place in the pocket.

A second pocket 50 is secured to the lower front piece 24 on the opposite side of the vest from the pocket that carries the holster. The pocket 50 is secured to the inside face of the vest, and preferably to a reinforcing piece 52 of material that overlies the inside of the lower front piece 24. The pocket 50 is secured to this area by stitching 54 so that the pocket is upside down, with an opening 56 that faces downwardly toward the bottom edge 18 of the vest. The pocket has a flap 58 at the bottom that folds up over the pocket. Cooperating thistle cloth fasteners 60 on the inside of the flap and on the outside of the pocket 50 releasably fasten to close the lower opening of the pocket. The pocket can be adapted to carry accessories such as bullets or handcuffs, or other items that otherwise would have to be carried on a belt or in pockets elsewhere.

Figure 5:
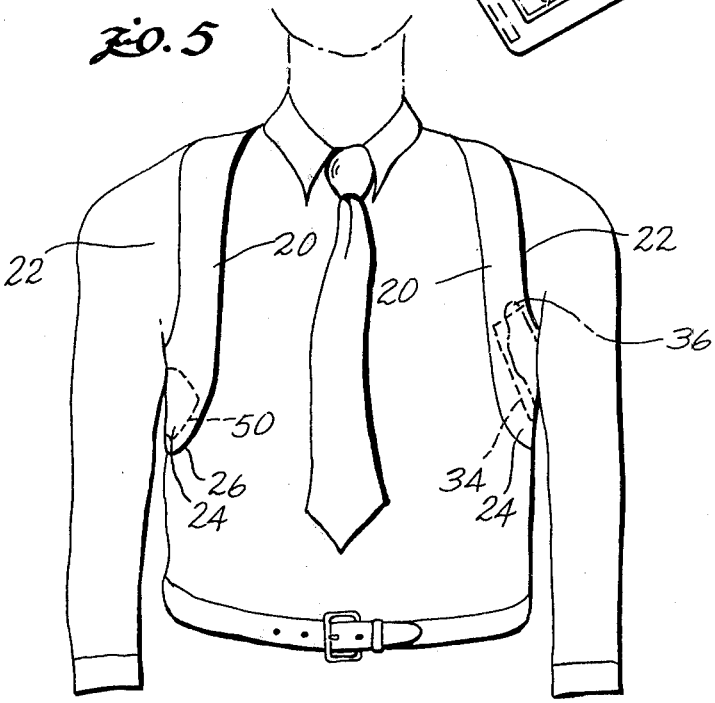
FIG. 5 is a front elevation view showing the vest during use.

FIG. 5 illustrates the vest-type shoulder holster during use. When the vest is worn on the upper body the lower front pieces extend under the arms and overlie side regions of the chest generally in the pectoral area. The holster 36 in the inside pocket 34 is carried at the side region of the chest generally inside and to the front of the underarm. The adjacent inside edges of the vest that border the upper and lower front pieces are spaced apart with a wide open area over the front middle region of the chest. This spacing conceals the vest when a coat worn over it is even worn unbuttoned. The vest provides uniform weight distribution across the upper body owing to the support provided by the vest extending over the shoulders, all around the shoulders, and across the back as a single piece of flexible fabric. The uniform weight distribution provided by the vest produces more comfort than a harness with straps, and the vest is concealable without bulges showing through the jacket. The vest is easily washable and can be made to fit the user without the added cost of adjustment devices used in harnesses. The vest also facilitates use of added pockets for carrying items on the other side. The uniform weight distribution of the vest also avoids the holster and firearm foom backing away from the user when reaching across the chest area to draw the firearm.

I claim:

1. A device for carrying firearms comprising:

a vest for being worn on the upper body with a pair of armholes on opposite sides of the vest for accommodating the arms when the vest is worn; the vest having a back section extending between opposite back edges of the armholes for overlying the back; a pair of narrow elongated upper front pieces extending from opposite sides of the back section along opposite front edges of the armholes for overlying the shoulders and opposite sides of the chest in front of the arm; and a pair of elongated lower front pieces extending from the upper front pieces of the vest downwardly under bottom edges of the armholes to opposite sides of the back section so the lower front pieces overlie opposite sides of the upper body beneath the arms; and upper front pieces being narrower than the lower front pieces; the lower front pieces tapering wider as they extend from the upper front pieces under the armholes and toward the back portion; the vest having an outside face and an inside face; the width of the upper and lower front pieces being sufficiently narrow that a space is formed between them along the middle of the chest region when the vest is worn; and a pocket for carrying a holster, the pocket being secured to the inside face of the lower front portion of the vest beneath an armhole, the pocket having an opening that faces generally toward the opposite side of the vest.

2. Apparatus according to claim 1 in which the inside of the pocket includes a fastener for releasable attachment to a cooperating fastener on such a holster for being carried in the pocket.

3. Apparatus according to claim 2 including a second fastener secured to the inside face of the vest adjacent the opening in the pocket for releasable attachment to a cooperating second fastener on such a holster.

4. Apparatus according to claim 1 including a second pocket secured to the lower front piece of the vest opposite the pocket for carrying a holster, the second pocket having an opening facing downwardly toward a bottom edge of the vest, and a flap on the second pocket for closing its downwardly facing opening.

5. Apparatus according to claim 1 in which the pocket has opposite side edges that extend at an angle of about 30 to 45 degrees relative to a line drawn through the bottom edges of the armholes.

6. Apparatus according to claim 1 in which the lower front pieces have corresponding outer edges that taper upwardly away from a bottom edge of the back portion, when the vest is in flat form.

7. Apparatus according to claim 1 in which the width of the lower front pieces below the armholes is about 1.5 to 2.5 times the width of the upper front pieces.

8. Apparatus according to claim 1 in which the maximum width of the lower front pieces is about 40% to 70% of the vertical width of the armholes.

9. A shoulder holster for carrying firearms comprising:

a vest for being worn on the upper body, the vest having an inside face, an outside face, and a lower front portion for extending adjacent the underarm on the front side of the upper body when the vest is worn;

a pocket secured to the inside face of the lower front portion of the vest;

a holster shaped to fit inside the pocket;

a first fastener on the holster; and a second fastener secured to the vest in the vicinity of the pocket for releasably attaching to the first fastener when the holster is carried in the pocket.

10. Apparatus according to claim 9 in which the first fastener is an elongated strip of a first type of thistle cloth material, and the second fastener is an elongated strip of a second type of thistle cloth material.

11. Apparatus according to claim 10 in which the second fastener is secured to the inside of the pocket.

12. Apparatus according to claim 9 including a third fastener on a portion of the holster opposite the first fastener, and a fourth fastener in the vicinity of the pocket for attaching to the third fastener when the holster is carried in the pocket.

13. Apparatus according to claim 9 including a second pocket secured to a similar lower front portion on the opposite side of the vest, the second pocket having a opening facing downwardly toward the bottom edge of the vest, and a flap for releasably closing the opening in the second pocket.

14. Apparatus according to claim 9 in which the vest includes a pair of armholes for accommodating the arms when the vest is worn on the upper body; and the vest includes a back portion extending between adjacent rear edges of the armholes; a pair of narrow, elongated upper front pieces extending along opposite front edges of the armholes, each upper front piece merging into a corresponding one of said lower front portions that extend below the armholes to opposite sides of the back section.

15. Apparatus according to claim 14 in which the pocket extends at an angle of about 30 to 45 degrees relative to a line extending through the bottom edges of the armholes.

16. Apparatus according to claim 14 in which the vest has a pair of opposite front edges that are spaced apart from each other when the vest is worn on the upper body, and the spacing between them, when the vest is worn, is greater than the width of either front piece.

* * * * *